United States Patent [19]

Mushines

[11] Patent Number: 4,843,824

[45] Date of Patent: Jul. 4, 1989

[54] SYSTEM FOR CONVERTING HEAT TO KINETIC ENERGY

[75] Inventor: Anthony Mushines, Fresno, Calif.

[73] Assignees: Dorothy P. Mushines; Sandra E. Banker; Gerald M. Mushines, all of Fresno, Calif. ; a part interest

[21] Appl. No.: 837,789

[22] Filed: Mar. 10, 1986

[51] Int. Cl.[4] ..... F22D 5/00

[52] U.S. Cl. ..... 60/667; 60/657; 122/406 R

[58] Field of Search ..... 60/665, 667, 653, 658, 60/657, 689; 122/406 R, 452

[56] References Cited

U.S. PATENT DOCUMENTS 2,921,441 1/1960 Buri ..... 60/667

3,733,819 5/1973 Mushines ..... 60/664

4,430,962 2/1984 Miszak ..... 60/657

*Primary Examiner*—Stephen F. Husar

*Attorney, Agent, or Firm*—Worrel & Worrel

[57] ABSTRACT

A system for converting heat to kinetic energy, the system characterized by a fluid driven motor responsive to an introduction of high pressure fluid for driving a selected power train, and a pressure generator for introducing the high pressure fluid to the motor. The pressure generator includes a plurality of boiler tubes for receiving low pressure fluid, a fire box for successively transferring heat to the boiler tubes, and a pressure equalizer for incrementally equalizing pressures within the boiler tubes, whereby an introduction of low pressure fluid, followed by an efficient conversion to a high pressure fluid, is facilitated within the system.

10 Claims, 3 Drawing Sheets

SYSTEM FOR CONVERTING HEAT TO KINETIC ENERGY

BACKGROUND OF THE INVENTION

1. Field of the Invention

The present invention relates to an energy conversion system and more particularly to an improved system for converting heat to kinetic energy.

2. Description of the Prior Art

Numerous systems heretofore have been employed in converting heat to usable energy. Normally, such systems include a boiler where a liquid is converted to a vapor and admitted to a turbine where it is expanded across the blades, discharged therefrom and thence returned via a feed pump to the boiler.

The Applicant's U.S. Pat. No. 3,733,819, filed July 16, 1971, entitled "System For Converting Heat To Kinetic Energy", contains a disclosure of an embodiment entitled "Vapor Generator (Second Form)". The preferred embodiment of the instant invention constitutes an improvement in this embodiment of the Applicant's prior invention. In that patent of the Applicant, various substances can be employed as the working fluid and Freon is employed in the preferred embodiment.

Attending the increased use of working fluids employed in the field of vapor generators is the prevailing interest in the development of conversion systems which can be employed efficiently with more substances, including Freons, hydrocarbons and combinations, compositions and multi-components of these substances. But the instant invention is not limited to these and other working mediums can efficiently be employed in the system of the instant invention.

Applicant's prior patent related to a first system for generating energy. It provided means for the spent low pressure working fluid to recycle into the pressure generator, through a method of exchange of pressures and temperatures in incremental steps in a system employing a plurality of regeneration stages. The system thereby substantially avoided the effect of system back pressure and related difficulties associated with the reentry of mixed substances.

SUMMARY OF THE INVENTION

It is therefore an object of the instant invention to provide an improved system for converting heat to kinetic energy.

Another object is to provide such a system which employs the energy of heat for imparting driven motion to a selected power train in a simplified form.

Another object is to provide such a system having an improved pressure generator wherein the effect of back pressure and other difficulties are substantially eliminated as a working fluid is introduced into the generator.

Another object is to provide such a system having a pressure generator means for simultaneously receiving a working fluid in gaseous liquid phase, heating it to effect a partial vaporization, pressure equalizing means for incrementally increasing the temperature and pressure of the preceding evaporation stage thereby providing for replenishment of working medium under low pressure conditions.

Another object is to provide such a system having a pressure generator composed of a plurality of evaporative stages arranged in a series terminating in a super heater stage.

Another object is to provide such a system having a heat source originating in the super heater to terminate in the diametrically opposite and most distant location relative to the super heater.

Another object is to provide such a system wherein the working fluid can be, but is not limited to, Freon, hydrocarbons, and combinations of any and all suitable substances in binary, composite, or multi-component composition.

Another object is to provide such a system which constitutes the most suitable and efficient working fluid medium.

These and other objects and advantages are achieved in the system of the instant invention providing increased efficiency in a simplified design of a continuous cycle capable of developing very high pressures and of individually employing an unlimited number of working fluids in a system that is feasible.

DESCRIPTION OF THE PREFERRED EMBODIMENTS

Figure 1:
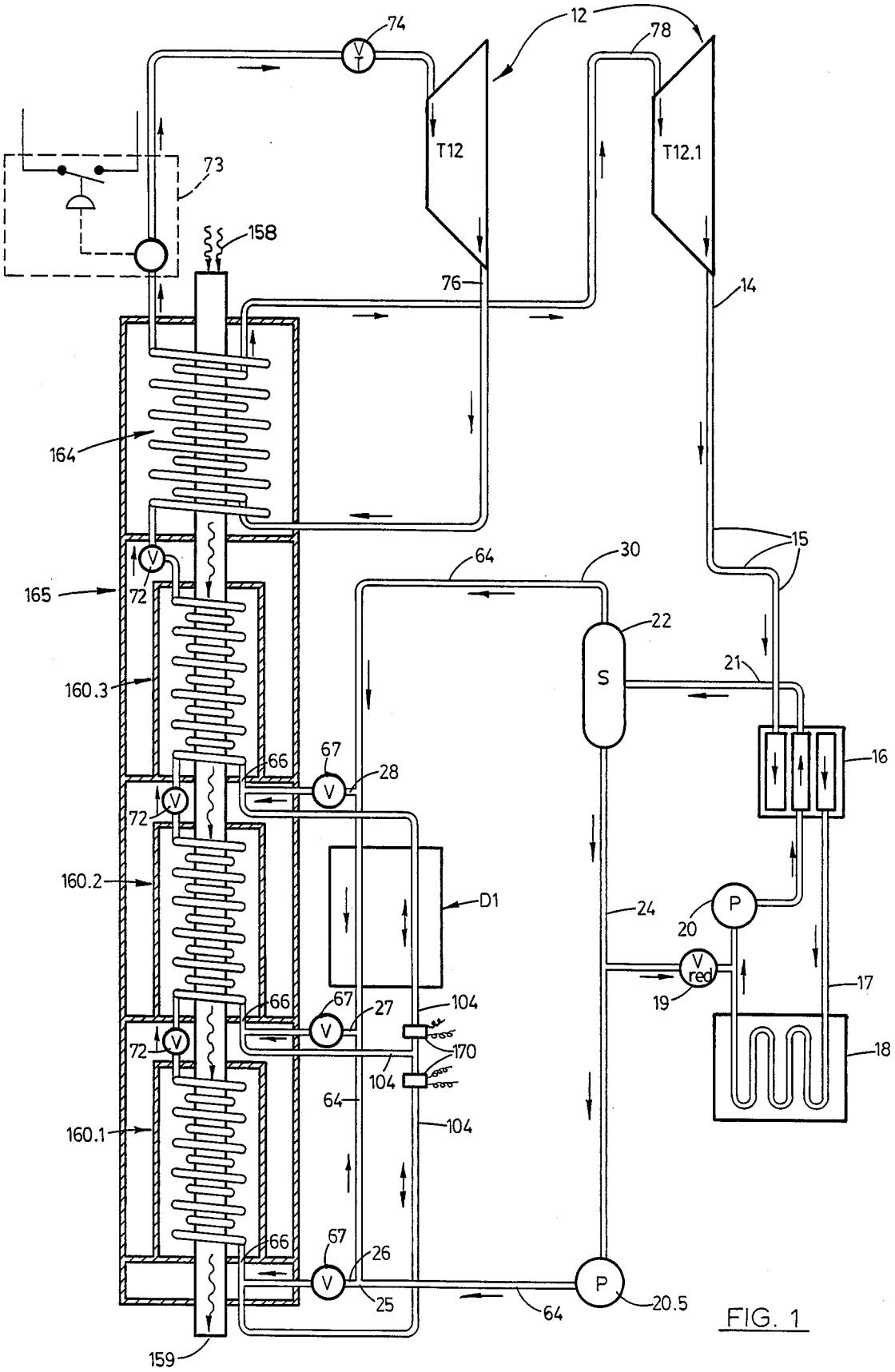
FIG. 1 is a diagrammatic view, not to scale, of a system embodying the principles of the instant invention, including a composite vapor generator composed of a super heater and associated evaporators, a multi-stage turbine associated with the vapor generator, heat exchangers, a condenser and a gravity separator.

FIG. 1 shows a system which embodies the principles of the instant invention. The system includes a composite vapor generator or boiler, generally designated 165, having a super heater generally designated 164 and a series of three evaporators designated 160.1, 160.2, and 160.3, respectively. The system can contain more super heater stages and/or more evaporator stages, coupled with a prime mover 12. In the preferred embodiment, the prime mover is composed of multi-stage turbines having a high pressure stage and a low pressure stage generally designated T12 and T12.1, respectively.

Figure 5:
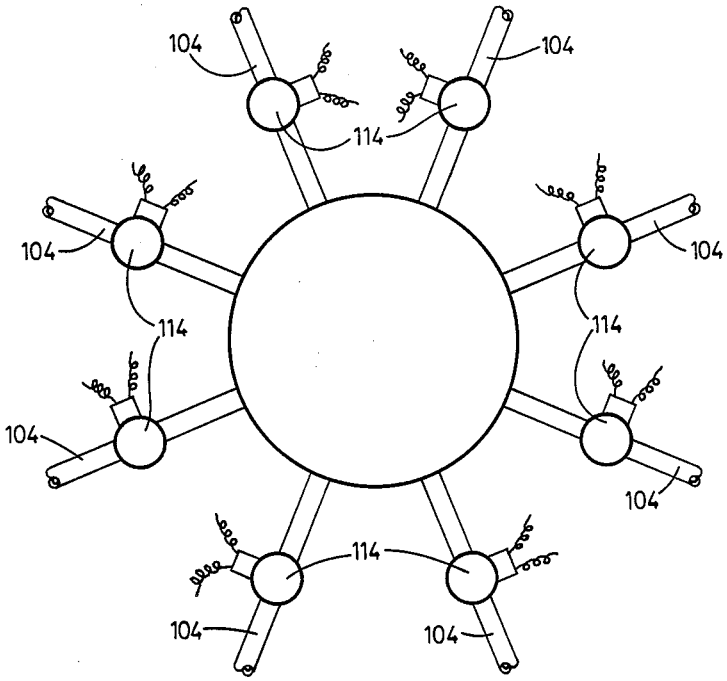
FIG. 5 is a schematic view of a modified form of a pressure equalizing valve employable with the vapor generator of the present invention.
Figure 3:
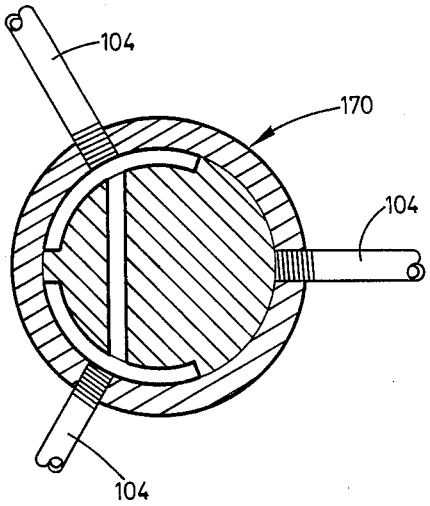
FIG. 3 is a sectioned elevation of a modified form of a valve employable as a pressure equalizer in the system of FIG. 1.

It is to be understood, of course, that the vapor generator 165 serves as a continuous source of heated fluid, preferably a gaseous vapor, which is directed through the prime mover 12 for imparting motion thereto. From the prime mover, the working fluid is delivered to the heat exchanger, generally designated 16, and a condenser, generally designated 18 which are consecutively coupled to the outlet duct of turbine T12.1 to thereby receive the spent low pressure working fluid. The particular prime mover employed is a matter of convenience and, therefore, a detailed description is omitted in the interest of brevity. Similarly, heat exchangers, condensers, pumps, separators, and all attendant hardware, such as conduits, check valves, pressure reduction valves, pressure switches, and the pressure equalizing valve, as hereinbefore illustrated in the embodiments of FIG. 3, FIG. 4, FIG. 5, etc., are all within the purview of the art.

The low pressure working fluid is converted to a relatively cooled liquid gas, condensed state, then to be pressurized by pump 20 and heated in the heat exchanger 16 prior to delivery to separator 22. In the separator the liquids can partially be separated from any remaining gaseous vapors. Such gaseous vapors will be remaining if, as a matter of convenience, binary or multi-component composite working fluids are employed as the preferred working medium.

OPERATION

With the system of the instant invention assembled in the manner hereinbefore described, it is to be understood that the prime mover 12 is driven through a delivery of the high pressure, vaporized working fluid from the vapor generator 165 through the throttle valve 74. The high pressure vaporized working fluid expands across the blades of the high pressure stage turbine T12 and emerges at point 76, having converted its usable energy into kinetic energy. It may then, as a matter of convenience, be recycled through the super heater 164, loop 76 to point 78 whereby the recharged high pressure gaseous working fluid expands across the low pressure stage of turbine T12.1 thereby releasing its energy. The relatively low pressure, low temperature spent working fluid at point 14 is directed via conduit 15 to flow through heat exchanger 15 and condenser 18 transforming into a partially condensed state. Thereafter, it undergoes a pressure increase through pump 20 and heat exchanger 16.

After separation by separator 22, the pressurized condensate is caused to be absorbed into the composite working fluid stream through the pressure reducing valve 19, to thereafter be recycled through the compression, expansion, and separations loop thereby undergoing substantial liquefaction.

Pump 20.5 accelerates the working fluid stream along flow line 64 to point 25, wherein, it is important to note, it is coupled in a communicating relationship with the plurality of evaporator influent ducts 66 at points 26, 27 and 28, coupled to evaporators 160.1, 160.2 and 160.3 respectively. It is further understood that this communication has unidirectional parameters established by interposing check valves 67, as illustrated in FIG. 1 and FIG. 2 of the drawings.

It is readily apparent that this flow line 25 to 28, essentially, is an input manifold to the series of evaporators 160.1, 160.2 and 160.3. It will also be noted that this input manifold is further coupled to point 30, along flow line 64. Thus, it may receive any discharge from separator 22 of a gaseous vapor working fluid, resulting when the preferred medium, as a matter of convenience, is of a binary, composite or multi-component substance. Thereafter, the working fluid becomes partially mixed and passed through distillation, generally designated D1. The composite working fluid is principally in thermodynamic equilibrium. The fluid conduit 104 passing in heat exchange through D1 may, as a practical matter, originate from any or all the series of evaporators thereby offering temperature ranging from the lowest temperature of the series at evaporator 160.1 and including the highest temperature, as FIG. 1 of the drawings illustrates, emanating from evaporator 160.3

Figure 2:
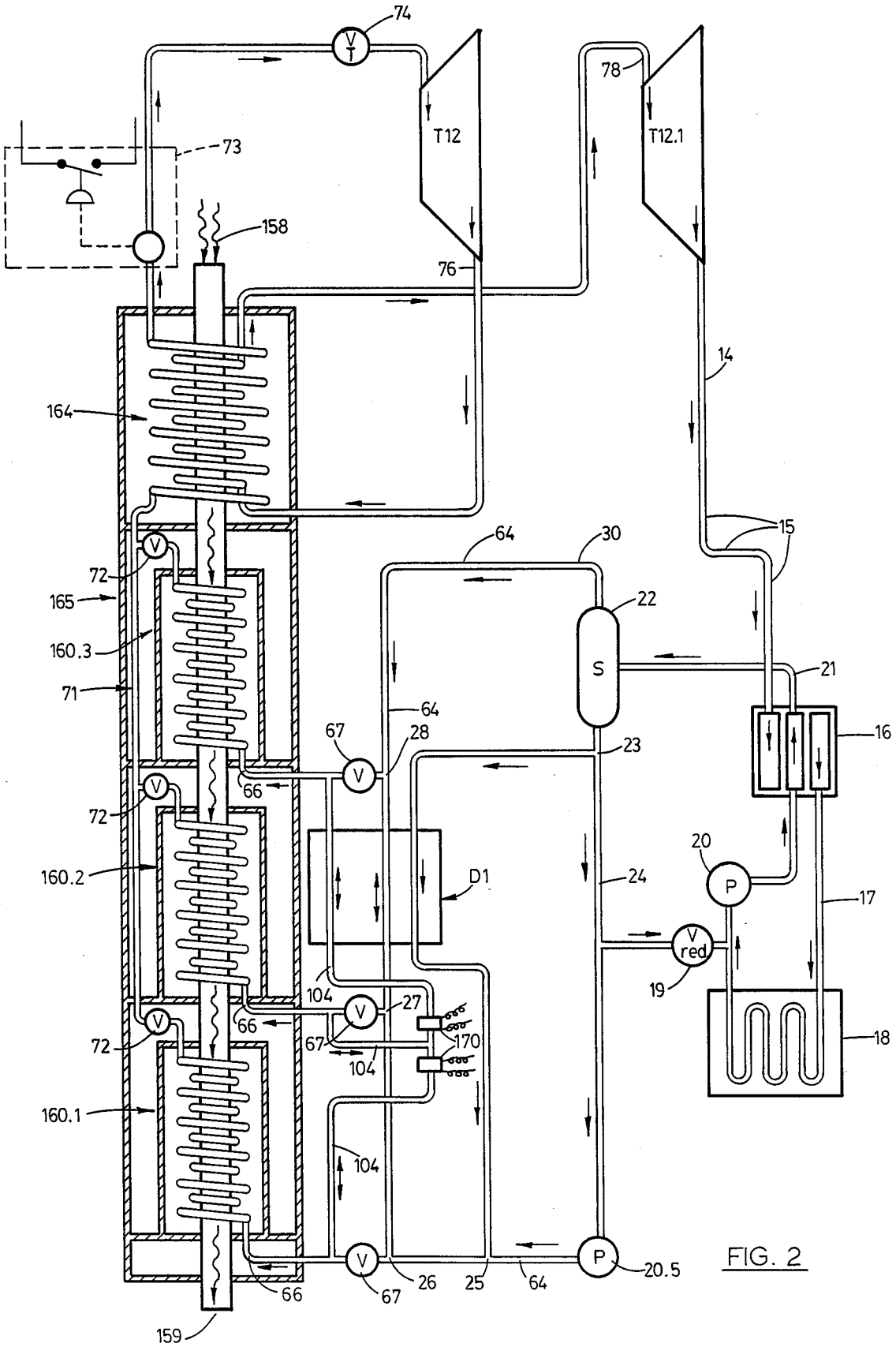
FIG. 2 is a diagrammatic view of a second embodiment of the system of the present invention.

The higher boiling liquid component at point 23 may be further distilled at D1 to bring it into temperature equilibrium at 25 as illustrated in the alternate embodiment shown in FIG. 2 In addition, the condensed liquid working fluid may, through 24 to 19 undergo a pressure reduction through valve 19 thereby permitting to be recycled into the original low pressure spent composite working fluid thereby regenerating the initial composite working fluid stream.

FIG. 1 and FIG. 2 of the drawings show a continuous heat source originating at 158 and flowing through the composite vapor generator or boiler, designated 165, to point 159. This creates a first highest temperature zone in the super heater stage 164, a second highest temperature zone in the evaporator generally designated 160.3, a third highest temperature zone in the evaporator generally designated 160.2 and a fourth highest temperature zone in the evaporator generally designated 160.1. It will then be readily apparent that with each evaporator coupled in succession with check valves 72 interposed between these successive evaporator stages, there will be unidirectional flow of the working fluid as the heat transfer of each successive evaporator incrementally elevates the pressure to thereby deplete the working fluid from that stage beginning with the super heater 164 stage.

The schematic representation of FIG. 2 illustrates an alternative embodiment employing an evaporative exhaust or output manifold 71 interposed between each evaporator and at the output manifold 71 thereby giving a unidirectional flow to the working fluid emanating from each evaporator an independent access to the super heater 164. This embodiment 71 may be particularly significant in some applications of the assembled apparatus of the instant invention.

The applicant's U.S. Pat. No. 3,733,819 first disclosed a pressure-generator with a plurality of sequentially heated boiler tubes interconnected through a valve that operatively connects selective paired boiler tubes sequentially thereby communicating their heat and pressures to a balanced state. Several valves disclosed in that patent are employable in the instant invention and ar shown herein as alternative embodiments in accordance with the instant invention in FIG. 3, FIG. 4 and FIG. 5. These valves may operatively be controlled by electrical impulse from pressure switch 73 in FIG. 1 in response to a pressure variation or, as a matter of convenience, indexed to an automatic timed interval.

Figure 4:
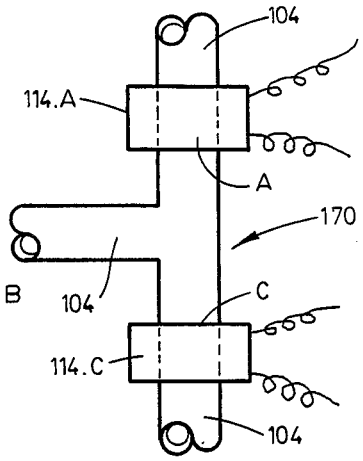
FIG. 4 is a simplified schematic view of one embodiment of a valve employable as a pressure equalizer in the system of FIG. 1.

This is readily apparent in viewing valve 170 shown in FIG. 4, for example, wherein conduits 104 originating from ducts 66 emanating from evaporators converge in valve 170. The preferred embodiment, shown in FIG. 4, is depicted having valves placed at positions A and C. These may, as a matter of convenience, be solenoid or hydraulic actuated, or any other economically and materially feasible valve. These valves are provided in a normally closed position. It is to be understood that when valve 114A is operatively opened, the evaporator connected to A through bleeder tube 104 will communicate in a paired relationship with the evaporator coupled at B through bleeder tube 104, their pressures and temperatures momentarily essentially balanced.

Thereafter valve 114.A returns to its normally closed position, the time elapse determined by the working solutions involved and the available heat transfer in the evaporators and desired vapor output. Sequentially valve 114.C opens immediately following the closure of valve 114.A. Now the evaporator connected at B through bleeder tube 104 is coupled in direct communication with the next in line evaporator coupled at C through conduit 104 thereby achieving a momentary pressure balance and some heat transfer therebetween. These cycles are repeated as often as is necessary for reasons hereinbefore discussed.

Now to recapitulate the aforementioned cycles in orderly relation of occurrence. Within composite boiler 165, as achieved by pumps 20 and 20.5 operating in the manner hereinbefore described, fluid in its gaseous liquid state is delivered to each of check valves 67 interposed in the feeder tubes 66 via flow line 64. The fluid is passed into the input manifold 26, 27 and 28 wherein heat is provided at a first highest temperature to super heater 164. Therefore, it will attain a first highest pressure. A second highest temperature is provided to evaporator 160.3 and therefore it will attain a second highest temperature. A third highest temperature is provided to evaporator 160.2 and therefore it will attain a third highest pressure and, in this case, lastly, a fourth highest temperature is provided to evaporator 160.1 and therefore it will attain a fourth highest pressure.

Whereas the temperature is substantially constant in the super heater 164, the working fluid experiences a pressure decrease as continuous vaporization and discharge depletes the working fluid therein. This pressure decrease brings super heater pressure in conformity with evaporator 160.3 pressure wherein a vapor flow will be maintained between evaporator 160.3 and super heater 164 for a limited time interval. At a predetermined pressure drop experienced in pressure switch 73, the pressure balancing valve 170 opens to permit evaporators 160.3 and 160.2 to achieve a pressure balance and some heat transfer, thereafter valve 170 closes. This process has now left evaporator 160.3 with a decrease in temperature and a recharge of a vaporous working fluid solution which will now, with the second higher heat level of 160.3, develop a higher pressure and with the first highest heat level of super heater 164 be increased further again. This process is repeated as hereinbefore described as the evaporator 160.2 and evaporator 160.1 are also brought into association immediately following the previous process. This continuing stepped up process of vaporization, accordingly, it is to be appreciated, leaves evaporator 160.1 and fourth highest temperature in a depleted condition relative to the initial working fluid solution. This sequential cycling of communicating selective pairs of evaporators is rotationally recurrent.

This process of pressure and temperature balancing between the selective evaporators, beginning with the highest temperature, highest pressure boiler decreasing to the lowest temperature, lowest pressure boiler in the series, wherein the number of boilers in a series is a matter of convenience, relates to having a multiplicity of pressure and temperature conditions prevailing in the input manifold 26, 27 and 28. This constantly fluctuating thermodynamic state, limited only by number of evaporators employed and the effective temperature range determined, enables the system to employ a wide range of binary, multi-component compositions of various substances, hydrocarbons, Freons, and such having varied boiling points. This constant varying of pressure and temperature at the evaporator input ports can substantially assure that the working fluid thereat will approximate the equilibrium state necessary to effectively combine with the working fluid confined therein.

In view of the foregoing, it should be readily apparent that the system of the instant invention provides a practical solution to the problems of improving the efficiency of converting heat to kinetic energy.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. An improved system for converting heat to kinetic energy, the system comprising:

A. means including a fluid driven motor responsive to an introduction of fluid under an elevated pressure for imparting driven motion to a selected power train;

B. fluid control means for introducing fluid at a first given elevated pressure to said fluid driven motor, said fluid control means including, (1) a composite pressure generator including means defining a succession of fluid intake ports, a succession of fluid output ports, and a plurality of boiler tubes each of which serves to couple a fluid output port in direct communication with a fluid intake port;

(2) fluid delivery means coupled with said intake ports for successively delivering to said boiler tubes fluid at a second given pressure, said fluid delivery means including, (A.) a heat exchanger coupled with said fluid driven motor for cooling the fluid subsequent to an introduction thereof to said fluid driven motor and prior boiler tubes;

(B.) a separator (C.) a condenser coupled with said heat exchanger for condensing the fluid, subsequent to an introduction thereof to said heat exchanger and prior to a delivery thereof to said separator;

(D.) a manifold coupled with said separator;

(E.) a plurality of feeder conduits associated with each intake port for coupling the intake port with said manifold; and (F.) a one-way check valve interposed in each of said feeder conduits for imposing unidirectional flow characteristics on the fluid as it is delivered to the boiler tubes;

(3) means for heating the boiler tubes in succession whereby the pressure of the fluid within successive boiler tubes is elevated incrementally from said second given pressure to said first given pressure; and (4) fluid transfer means for conveying heated fluid from said output ports to said fluid driven motor at said first given pressure; and C. fluid return means for returning the fluid from said fluid driven motor to said fluid control means at said second given pressure.

2. The system of claim 1 wherein said means for successively heating the boiler tubes includes:

(A.) a continuous heat generating sources, baffled for stepped progression in heat exchanging relation with a plurality of said boiler tubes arranged in series;

(B.) a continuous heat source wherein a super heater has the first highest temperature, thereafter progressively diminishing to lowest temperature in the boiler tubes of said series;

(C.) pressure responsive means interposed in said fluid transfer means for detecting pressure changes occurring in said fluid transfer means; and (D.) means coupled with said pressure responsive means for activating an equalizer valve in responses to selected pressure changes as they occur in said fluid transfer means.

3. The system of claim 2 further comprising:

A. means including a super heater tube having opposed ends coupled with said fluid transfer means, for receiving from and discharging to the transfer means heated fluid in a continuous heat exchanging relation with the heat source;

B. a one-way check valve for imposing unidirectional flow characteristics on the fluid as it is received by the boiler tubes; and C. a control valve, interposed between the super heater and the fluid transfer means, for limiting discharge of the heated fluid from said super heater to the fluid transfer means.

4. The system of claim 3 wherein said fluid transfer means includes a plurality of input fluid ports and a plurality of output fluid ports coupled in a communicating relationship interposed by a plurality of one-way check valves for imposing unidirectional flow characteristics.

5. The system of claim 4 wherein said fluid transfer means includes a manifold and means including a plurality of one-way check valves for coupling each of said output fluid ports with the manifold.

6. The system of claim 5 further comprising a pressure exchange system coupled with each of said boiler tubes, including means for developing in stepped progression a third and a fourth pressure within each of said boiler tubes.

7. The system of claim 6 wherein the pressure exchange system includes means defining a plurality of bleeder tubes each communicating with one of said boiler tubes, and a multi-ported valve operatively coupled with said bleeder tubes in a variable relationship for simultaneously coupling selected bleeder tubes in variable pairs, whereby the boiler tubes are caused to communicate in a variably paired relationship for thereby selectively accommodating a pressure exchange between selected boiler tubes.

8. The system of claim 7 further comprising a control means interposed in each of said bleeder tubes.

9. The system of claim 8 wherein said second pressure is greater than said third pressure, and said first pressure is greater than said fourth pressure.

10. The improved system of claim 12 wherein said pressure generator includes a fluid heater of greater heating capacity than said boiler tubes and said fluid system includes means for selectively independently diverting fluid from each of said boiler tubes through said greater heating capacity fluid heater.

* * * * *

UNITED STATES PATENT AND TRADEMARK OFFICE

CERTIFICATE OF CORRECTION

PATENT NO. : 4,843,824

DATED : July 4, 1989

INVENTOR(S) : Anthony Mushines

It is certified that error appears in the above-identified patent and that said Letters Patent is hereby corrected as shown below:

Column 3, Line 30

Delete "15" and insert ---16---

Column 3, Line 63

Delete "temperature" and insert ---temperatures---

Column 4, Line 41

Delete "ar" and insert ---are---

Column 8, Line 23

Delete "12" and insert ---]

Signed and Sealed this

Thirteenth Day of March, 1990

*Attest:*

JEFFREY M. SAMUELS

*Attesting Officer*

*Acting Commissioner of Patents and Trademarks*